United States Patent [19]

Gibson

[11] Patent Number: 4,930,164

[45] Date of Patent: Jun. 5, 1990

[54] DOUBLE DRAIN

[76] Inventor: Robert L. Gibson, 5471 Homestead La., Bay City, Mich. 48706

[21] Appl. No.: 309,704

[22] Filed: Feb. 13, 1989

[51] Int. Cl.[5] ..... E05C 1/22

[52] U.S. Cl. ..... 4/199; 4/204

[58] Field of Search ..... 4/198, 199, 201, 203, 4/546, 559, 200, 204, 202; 137/625.35, 625.40; 68/208; 134/186

[56] References Cited

U.S. PATENT DOCUMENTS

| | | | |
|---|---|---|---|
| 1,901,649 | 3/1933 | Huber | 4/203 |
| 2,036,692 | 4/1936 | Groeniger | 4/199 |
| 3,314,082 | 4/1967 | Minella | 4/199 |
| 3,614,952 | 10/1971 | Agnellino | 4/544 |
| 3,693,197 | 9/1972 | Christiansen | 4/203 |
| 4,352,213 | 10/1982 | Watts | 4/199 |
| 4,669,131 | 6/1987 | Barlow | 4/199 |

*Primary Examiner*—Henry J. Recla
*Assistant Examiner*—Glenn T. Barrett
*Attorney, Agent, or Firm*—John J. Swartz

[57] ABSTRACT

Double drain apparatus for concurrently draining vertically spaced portions of a bathtub or the like containing liquid, such as water, comprising an upstanding drainpipe having upper and lower drain openings therein, valve mechanism for controlling the flow of liquid through the upper and lower openings including upper and lower hollow stopper cylinders mounted in the drainpipe for sliding movement between positions blocking the upper and lower openings and vertically spaced drain positions. Mechanism is provided for concurrently moving the upper and lower stopper cylinders between the blocking and drain positions.

23 Claims, 1 Drawing Sheet

DOUBLE DRAIN

BACKGROUND OF THE INVENTION

1. FIELD OF THE INVENTION

This invention relates to apparatus for draining a liquid container and more particularly to a double drain for concurrently draining vertically spaced drain portions of a liquid container, such as a bathtub.

2. DESCRIPTION OF THE PRIOR ART

Bathtubs typically include a main drain opening in the bottom wall thereof. As the water is drained from the tub, the draining is normally quite slow and a portion of the soap and other foreign objects, which generally float atop the water, will collect on the sidewalls.

It has been discovered that less material will cling to the wall of a bathtub during draining if the surface water, and the soap and other foreign material therein, is skimmed off the surface before all of the water is drained from the tub. It has been found that a second drain opening provided in vertically spaced relation with the bottom drain opening functions as a skimmer which skims off the foreign material, such as before it collects on the tub sidewall. Accordingly, it is an object of the present invention to provide a new and novel drain for a liquid container, such as a bathtub, including vertically spaced, upper and lower drains.

It is another object of the present invention to provide drain apparatus of the type described which includes a vertical drainpipe having a pair of vertically spaced drain openings, vertically spaced valves disposed in the drainpipe for opening and closing closing the openings, and mechanism for concurrently moving the valves between the open and closed positions.

The apparatus constructed according to the present invention includes axially aligned, hollow valve cylinders which are received in the vertical drainpipe and are selectively movable to and from positions blocking the openings. Accordingly, it is an object of the present invention to provide new and novel drain apparatus including a cylindrical drain stopper having vertical passages therethrough.

The U.S. Pat. No. 1,901,649, issued to O.B. Huber, on Mar. 14, 1933 and the U.S. Pat. No. 3,693,197, issued to Gerald E. Christiansen, on Sept. 26, 1972, are illustrative of the usual single drain wherein a cylindrical tubular plug is employed. In the prior art bath drains, however, such as that disclosed in the above referenced patents, there is no concept of providing a second drain nor the concept of having axially aligned, concurrently movable hollow cylindrical valves disposed within a drainpipe.

The U.S. Pat. No. 3,614,952, issued to A.D. Agnellino on Oct. 26, 1971, discloses a hydrotherapeutic bathtub having a floor drain and a wall outlet in vertically spaced relation thereto, however, the wall outlet provides a return circulation path for liquid circulated via a pump to in-tub discharge ports and is not a waste drain.

Other objects and advantages of the present invention will become apparent to those of ordinary skill in the art as the description thereof proceeds.

SUMMARY OF THE INVENTION

Double drain apparatus for concurrently draining vertically spaced portions of a liquid container comprising: an upstanding drainpipe having a sidewall defining a vertical passage; the sidewall includes upper and lower drain openings for coupling to upper and lower portions of a container to be drained; valve mechanism for controlling the flow of liquid through the upper and lower openings to the vertical passage including upper and lower stoppers mounted in the vertical passage in sliding engagement with the sidewall for movement between liquid blocking positions in alignment with the upper and lower drain openings and vertically spaced, non-blocking positions in which liquid can flow through the upper and lower openings to the vertical passage; and mechanism for concurrently moving the upper and lower stoppers between the blocking and non-blocking positions.

BRIEF DESCRIPTION OF THE DRAWINGS

The invention may be more readily understood by referring to the accompanying drawings, in which.

DESCRIPTION OF PREFERRED EMBODIMENT

Figure 2:
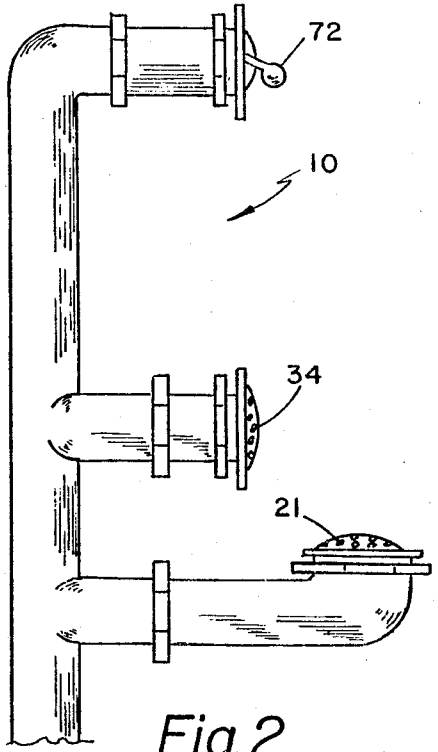
FIG. 2 is a reduced, side elevation view of apparatus constructed according to the present invention.

The apparatus constructed according to the present invention, generally designated 10, is particularly adapted for use with a tub, generally designated 12, having a bottom wall 14 and an integral, annular sidewall 16. The bottom wall 14 includes an opening 18 receiving a drainpipe 9 having an end cover 20 provided with a plurality of openings 21 therein as usual. The drainpipe 9, which is coupled to and received by one end of a drain elbow 24, may be held in position by a locking ring 22 bearing against the underside of the bottom tub wall 14. The opposite end of the waste elbow 24 is coupled to a horizontal discharge pipe P for communicating the water, generally designated W, to a vertical discharge pipe 38.

Apparatus is provided for skimming the surface water 26 and materials 27 embedded therein and includes a skim opening 28 in the tube sidewall 16. A hollow cylindrical annular drainpipe 30 is received in the tub wall opening 28 and includes a cover plate 32 having a plurality of openings 34 therein for receiving the surface water 26 and material 27 embedded therein. The diameter of the cover plate is slightly larger than the opening 28.

Apparatus, generally designated 36, is provided for receiving the water from the vertically spaced openings 18 and 28. The double drain apparatus 36 includes an upstanding drainpipe, generally designated 38, having a sidewall 39 defining a vertical drain passage 39A having an upper and lower drain openings 40 and 42, respectively. The openings 40 and 42 are coupled to the drainpipes 28 and 24 respectively via upper and lower pipes 44 and 46 respectively.

The upper end of vertical drainpipe 38 is integrally coupled to a horizontally disposed overfill pipe 38A which is coupled to tub sidewall 16 in alignment with an overflow opening 47 provided in tubwall 16. A cover plate 49, having an overflow passage 51 therein, covers the overflow opening 47. The passage 51 allows overflow water W, once the tub has reached its level, to pass therethrough into drainpipes 38A and 38.

Valve mechanism, generally designated 48, is provided for selectively blocking the vertically spaced drain openings 40 and 42 and includes upper and lower vertically reciprocally movable valve assemblies, generally designated 50 and 52. Each of the valve assemblies 50 and 52 includes a hollow cylinder 54 having an annular sidewall 55 spanned by a bar 56 which includes a hasp 58 along the top side thereof. The sidewall 55 is slidably received in passage 39A in sealing engagement with wall 39. The upper valve 50 also includes a lower transverse bar 60 which is in alignment with the bar 56 and mounts a lower hasp 62. The lower hasp 62 of upper valve 50 is coupled to the upper hasp 58 of the lower valve 52 via a rigid coupling bar 76.

The valves 50 and 52 are concurrently moved upwardly and downwardly via a lever assembly, generally designated 66, received within the horizontal overfill drainpipe 38A. The lever assembly 66 includes a hand actuated lever 68 pivoted at 70 on the sidewall 16 of the tub.

One end 72 of lever 68 projects into the tub enclosure through overflow opening 51 and is hand graspable to swing the lever 68 upwardly and downwardly, in the direction of the arrows 74 and 75. The opposite handle end 77 is coupled, via a pivot pin 78, to one end 80 of a bar 82 pivotally mounted in the overfill drainpipe 38A via a pivot pin 84. The lever 82 is coupled at its opposide end 86 to the upper end 88 of a bar 90, which is coupled to the upper hasp 58 of upper valve assembly 50. Another vertical bar 76 is coupled to the upper and lower hasps 58 and 62 of lower and upper valve assemblies 52 and 50.

When the lever 72 swings in the direction of the arrow 74, the lever 82 will also oppositely swing in the direction of the arrow 97 which forces the valves assemblies 50 and 52 to move upwardly to the non-blocking positions illustrated by chain lines, allowing water to flow from tub openings 18 and 28 to the vertical drainpipe 38.

Figure 1:
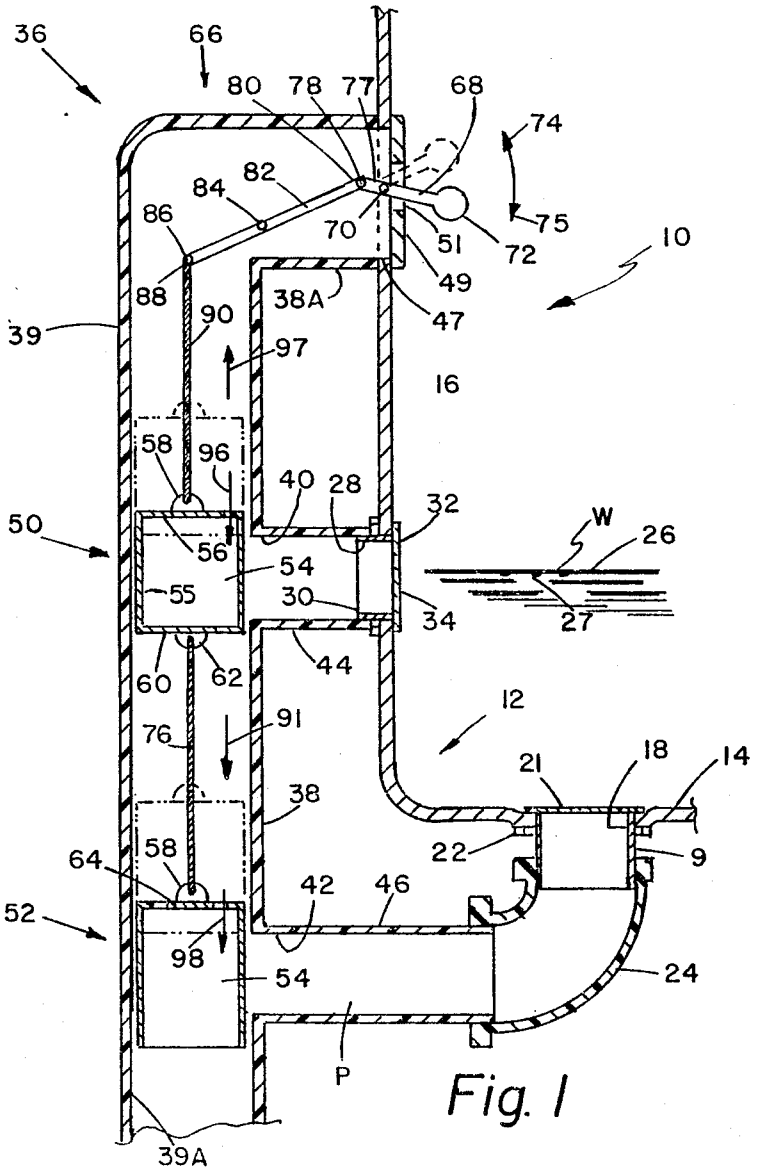
FIG. 1 is a sectional side elevational view of apparatus constructed according to the present invention.

When the lever 72 is swung in the opposite direction represented by the arrow 75, the lever 82 oppositely swings, in the direction of the arrow 91, to concurrently move the valves 50 and 52 downwardly, to the positions illustrated in solid lines in FIG. 1, blocking the drainpipe openings 40 and 42. The valve cylinders 54 of valves 50 and 52 are both hollow so that water passing downwardly, in the direction of the arrow 96 from the overflow drain opening 47 will pass through the valve cylinders 54 as represented by the arrows 98.

THE OPERATION

When it is desired to fill the tub with water, the drain lever 72 is positioned as illustrated in FIG. 1 with the valve assemblies 50 and 52 blocking the upper and lower drain openings 40 and 42.

The user can fill the tub 12 to any desired level. In the event that the user overfills the tub, the overflow water will pass through the overflow opening 47 and thence through the drain pipes 38A and 38 in the direction of the arrow 91. Although the cylinders 50 and 52 are blocking the openings 40 and 42, they are opened at their upper ends, except for a transverse bar 56, and thus will allow the water passing through overflow opening 51 to pass downwardly therethrough in the direction represented by the arrows 98.

When it is desired to drain the tub water W, the lever 72 is swung in the direction of the arrow 74 to move the valve assemblies 50 and 52 upwardly to the positions illustrated in chain lines in FIG. 1. A portion of the surface water 26 and materials 27 embedded therein, will be skimmed off the top surface thereof through the upper skim opening 28. This water will pass downwardly through the upper opening in the lower valve assembly 52. Concurrently, the main supply of water is being drained through the lower drain opening 18 into the drain pipe 38 via drain pipe opening 42.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Drain apparatus comprising:

generally vertical drainpipe means including a cylindrical sidewall defining a vertical drain passage;

said sidewall including upper and lower openings therein;

a first conduit coupled to said drainpipe means for communicating liquid to said lower opening;

a second conduit coupled to said drainpipe means for communicating liquid to said upper opening;

a first valve mounted in said vertical drain passage for vertical reciprocal movement between a stopping position, aligned with said lower opening, interrupting the flow of liquid from said first conduit to said vertical drain passage, and a vertically spaced, draining position allowing the flow of liquid from said first conduit to said vertical drain passage;

a second valve mounted in said vertical drain passage for vertical reciprocal movement between a stopping position, aligned with said upper opening, interrupting the flow of liquid from said second conduit to said vertical drain passage, and a vertically spaced non-blocking position allowing the flow of liquid from said second conduit to said vertical passage; and means for moving said first valve in said vertical passage between said stopping position and said draining position and for concurrently moving said second valve in said vertical passage between said blocking position and said non-blocking position.

2. The apparatus set forth in claim 1 wherein said means for concurrently moving said valves includes means disposed in said passage.

3. The apparatus set forth in claim 1, wherein said first valve comprises a cylinder having a cylindrical sidewall slidingly received in said vertical passage, said cylinder including a vertical passage therethrough for allowing liquid received by said drainpipe means from said upper opening to pass therethrough.

4. The apparatus set forth in claim 3 wherein said means for concurrently moving said valves includes coupling means disposed within said vertical drain passage coupled to said first and second valves, and lever means for vertically moving said coupling means in a to-and-fro vertical path of travel.

5. The apparatus set forth in claim 4 including means for mounting said lever means in said overflow opening provided in said container sidewall above said skim opening.

6. The apparatus set forth in claim 4 wherein said second valve comprises a cylinder having a sidewall slidingly received by said vertical drain passage; said cylinder having a vertical passage therethrough for allowing liquid received from said overflow opening in said tub to pass therethrough.

7. The apparatus set forth in claim 6 wherein said first conduit includes an upstanding terminal end having an upwardly opening opening therein.

8. The apparatus set forth in claim 7 wherein said second conduit is horizontally disposed above the level of said first conduit.

9. The apparatus set forth in claim 8 wherein said second conduit includes a terminal end including a horizontally disposed opening therein at a level above the level of said upwardly opening opening.

10. A bathtub for storing bath water which may include foreign material entrained therein at its surface comprising:

a bottom wall having a main drain opening therein for draining water from the bottom of said tub;

a sidewall, joined to said bottom wall, including a skim drain opening disposed therein at a level above the level of said main drain opening for draining water and any foreign material entrained therein at a level above the bottom of said tub;

first drainpipe means coupled to said skim drain opening;

second drainpipe means coupled to said main drain opening;

first valve means movable between a blocking position, interrupting the flow of water through said first drainpipe means, and a non-blocking position;

second valve means movable between a blocking position interrupting the flow of water through said second drainpipe means and a non-blocking position; and means for concurrently moving said first and second valve means between said blocking positions and non-blocking positions.

11. The bathtub set forth in claim 10 including a vertical drainpipe having a cylindrical sidewall defining a vertical passage in fluid communication with said first and second drainpipe means.

12. The bathtub set forth in claim 11 wherein said cylindrical sidewall includes upper and lower openings therein in liquid communication with said first and second drainpipe means respectively, said first and second valve means being axially aligned in said vertical passage.

13. The bathtub set forth in claim 12 wherein said means for moving said first and second valve means includes means coupling said first and second valve means together for concurrent movement.

14. The bathtub set forth in claim 13 wherein said bathtub sidewall includes an overflow drain opening therein above said skim drain opening; said means for moving said valves includes lever means received by said skim drain opening.

15. The bathtub set forth in claim 14 wherein said second valve means includes a cylinder having a vertical passage therethrough for vertically passing water received from said skim drain opening.

16. The bathtub set forth in claim 15 wherein said first valve means comprises a cylinder having a vertical passage therethrough for vertically passing water received from said overflow passage.

17. The bathtub set forth in claim 16 wherein said first and second valve means are axially aligned.

18. Double drain apparatus for concurrently draining vertically spaced portions of a container, such as a bathtub, containing liquid, such as water, comprising an upstanding drainpipe having a sidewall defining a vertical passage;

said sidewall including upper and lower drain openings for coupling to upper and lower portions of a container to be drained;

valve means for controlling the flow of liquid through said upper and lower openings to said vertical passage including upper and lower stopper means mounted in said vertical passage in sliding engagement with said sidewall for movement between liquid blocking positions in alignment with said upper and lower drain openings and verticallly spaced, non-blocking positions in which liquid can flow through said upper and lower openings to said vertical passage, and means for concurrently moving said upper and lower stopper means between said blocking and non-blocking positions.

19. The double drain apparatus set forth in claim 18 wherein said means for concurrently moving said stopper means includes means disposed within said vertical passage.

20. The double drain set forth in claim 19 wherein said lower stopper means includes a passage therethrough for passing liquid received in said vertical passage through said upper opening.

21. The double drain set forth in claim 20 wherein said drainpipe includes overflow opening means above said upper stopper means and said upper stopper means includes a passage therethrough for passing any liquid received by said vertical passage at a level above said upper stopper means.

22. The double drain set forth in claim 21 wherein each of said stopper means comprises a hollow cylindrical valve.

23. The double drain set forth in claim 19 including upper and lower transversely extending conduits in fluid communication with said upper and lower openings for communicating liquid from vertically spaced portions of said container to said upper and lower openings.

* * * * *